US011002057B1

(12) United States Patent
Micinski et al.

(10) Patent No.: US 11,002,057 B1
(45) Date of Patent: May 11, 2021

(54) WINDOW OPERATING SYSTEM

(71) Applicant: Dynamic Hardware Technologies LLC, Tucson, AZ (US)

(72) Inventors: John J. Micinski, Belvidere, IL (US); Frank W. Campbell, Tucson, AZ (US)

(73) Assignee: QuB LLC, Lake Elmo, MN (US)

( * ) Notice: Subject to any disclaimer, the term of this patent is extended or adjusted under 35 U.S.C. 154(b) by 174 days.

(21) Appl. No.: 16/028,568

(22) Filed: Jul. 6, 2018

Related U.S. Application Data

(60) Provisional application No. 62/571,912, filed on Oct. 13, 2017, provisional application No. 62/529,744, filed on Jul. 7, 2017.

(51) Int. Cl.

| | |
|---|---|
| ***E05F 15/627*** | (2015.01) |
| ***E05F 11/04*** | (2006.01) |
| ***E05F 15/619*** | (2015.01) |
| *E05F 11/16* | (2006.01) |

(52) U.S. Cl.
CPC ..... *E05F 15/627* (2015.01); *E05F 11/04* (2013.01); *E05F 15/619* (2015.01); *E05F 11/16* (2013.01); *E05Y 2900/148* (2013.01)

(58) Field of Classification Search
CPC ..... E05F 11/16
See application file for complete search history.

(56) References Cited

U.S. PATENT DOCUMENTS

| | | | | |
|---|---|---|---|---|
| 1,171,979 A | | 2/1916 | Rixson | |
| 1,179,963 A | | 4/1916 | Rixson | |
| 1,289,828 A | | 12/1918 | Lea | |
| 1,408,174 A | * | 2/1922 | Dautrick | E05F 11/48 160/193 |
| 1,409,459 A | | 3/1922 | Ludlow | |
| 1,423,817 A | | 7/1922 | Pitz et al. | |
| 1,444,393 A | | 2/1923 | Sohonfield | |
| 1,456,468 A | | 5/1923 | Sohonfield | |
| 1,478,856 A | * | 12/1923 | Hockenberry | E05F 11/04 49/113 |
| 1,570,232 A | | 1/1926 | Dyer | |
| 1,581,852 A | * | 4/1926 | Massie | E05F 11/48 49/360 |
| 1,619,167 A | | 3/1927 | Tuomi | |
| 1,622,385 A | | 3/1927 | Klein | |
| 1,692,843 A | | 11/1928 | King | |

(Continued)

FOREIGN PATENT DOCUMENTS

| | | | | |
|---|---|---|---|---|
| CA | 2356814 A1 | * | 6/2000 | E05F 11/06 |
| GB | 190904670 A | * | 7/1909 | E05F 11/34 |
| GB | 894981 A | * | 4/1962 | E05F 11/14 |

*Primary Examiner* — Catherine A Kelly
(74) *Attorney, Agent, or Firm* — Dicke, Billig & Czaja, PLLC

(57) ABSTRACT

A window operating system moves a window sash between an open position and a closed position. A window has a top member operatively connected to a bottom member by a first side member and a second side member to form a frame. The sash is mounted to the frame for relative movement between the open and closed positions. The window operating system comprises an operator and an elongate member. The operator has a rotating member, and the elongate member provides rotational movement to the rotating member of the operator and movement of the elongate member rotates the rotating member thereby opening and closing the sash.

19 Claims, 21 Drawing Sheets

(56) References Cited

U.S. PATENT DOCUMENTS 1,902,266 A 3/1933 Ripp
1,916,817 A 7/1933 Terhune
1,932,938 A 10/1933 Ripp
2,033,832 A 3/1936 Kelly
2,072,468 A 3/1937 Saur et al.
2,166,710 A 7/1939 Axe
2,182,574 A 12/1939 Anchilowitz
2,248,337 A 7/1941 Carroll
2,252,634 A 8/1941 Justason
2,315,542 A 4/1943 Peremi et al.
2,366,613 A * 1/1945 Hagstrom ..... E05F 11/34 49/252
2,585,122 A 2/1952 Hartman
2,620,523 A * 12/1952 Broleman, Jr. ..... E06B 3/5009 49/96
2,636,727 A 4/1953 Toth
2,709,582 A 5/1955 Chapman
2,717,778 A 9/1955 Christy
2,720,292 A 10/1955 Roberts
2,778,630 A 1/1957 Pearson
2,814,483 A 11/1957 Bentley
2,817,978 A 12/1957 Kennedy, Sr. et al.
2,917,791 A 12/1959 Klein
3,032,330 A * 5/1962 Stavenau ..... E05D 15/00 49/249
3,139,276 A 6/1964 Play
3,210,807 A 10/1965 Wallmann
3,337,992 A 8/1967 Tolson
3,508,449 A 4/1970 Kraina
3,792,619 A 2/1974 Cannon et al.
3,858,452 A 1/1975 Gatland et al.
3,881,575 A 5/1975 Manaugh
4,382,349 A 5/1983 Dunphy et al.
4,497,135 A * 2/1985 Vetter ..... E05D 15/30 49/252
4,605,252 A 8/1986 Yamamoto
4,823,508 A 4/1989 Allen
4,846,242 A 7/1989 Baier
4,860,493 A 8/1989 Lense
4,866,882 A 9/1989 Cappello
4,887,392 A 12/1989 Lense
4,937,976 A * 7/1990 Tucker ..... E05F 11/06 49/345
5,144,770 A 9/1992 Kraus et al.
5,195,935 A 3/1993 Fencel
5,205,074 A 4/1993 Guhl et al.
5,442,879 A 8/1995 Christensen
5,452,543 A 9/1995 VonWald et al.
5,493,813 A 2/1996 Vetter et al.
5,507,120 A 4/1996 Current
5,559,409 A 9/1996 Beierwaltes et al.
5,590,491 A * 1/1997 Piltingsrud ..... E05F 11/16 49/339
5,689,994 A 11/1997 Nagai et al.
5,826,377 A 10/1998 Simson et al.
5,839,230 A 11/1998 Liking et al.
6,044,587 A * 4/2000 Vetter ..... E05F 11/24 49/324
6,070,637 A 6/2000 Jancan
6,167,654 B1 * 1/2001 Wolf ..... E05F 1/008 49/357
6,244,660 B1 6/2001 Yoshimatsu
6,314,681 B1 11/2001 Moody
6,446,391 B1 * 9/2002 Timothy ..... E05F 11/04 49/330
6,460,294 B1 10/2002 Harkins
6,606,920 B2 8/2003 Hawkins et al.
6,640,389 B2 11/2003 Van Klompenburg et al.
6,672,010 B1 * 1/2004 Gledhill ..... E05F 11/34 49/339
6,925,757 B2 8/2005 Priest et al.
7,004,515 B2 2/2006 Timothy
7,013,604 B1 3/2006 Moody et al.
7,048,027 B1 5/2006 Abita
7,494,183 B2 2/2009 Liu
8,365,470 B1 * 2/2013 Campbell ..... E05F 11/34 49/343
8,434,265 B1 * 5/2013 Campbell ..... E05D 15/42 49/250
8,555,548 B2 * 10/2013 Carter ..... E05C 9/08 49/246
2002/0078630 A1 * 6/2002 Lee ..... E05F 11/16 49/342
2003/0110701 A1 * 6/2003 Dawson ..... E05F 11/16 49/246
2006/0169418 A1 8/2006 Gromotka et al.
2007/0052247 A1 3/2007 Timothy et al.
2008/0040978 A1 2/2008 Diekmann et al.
2008/0060276 A1 3/2008 Speyer et al.
2019/0003236 A1 * 1/2019 Hall ..... F16H 19/06

* cited by examiner 167
118
122
115
114
121
150
151
154
137
132
135
136
139
148
182
181
116

WINDOW OPERATING SYSTEM

RELATED APPLICATIONS

This application claims the benefit of U.S. Provisional Application No. 62/571,912, filed Oct. 13, 2017, and U.S. Provisional Application No. 62/529,744, filed Jul. 7, 2017.

BACKGROUND

This invention relates generally to a window operating system and, more particularly, to a window operating system that utilizes an elongate member to move a window operator between an open position and a closed position.

Most modern casement window operating assemblies utilize a rotary actuator that may be used to open or close a window sash. The actuator is typically in the form of a hand crank adapted to be turned in one direction to open the sash and in an opposition direction to close the sash. There are also instances where the actuator is operable by an electric motor.

There have been many types of actuators that have been utilized in the past. However, there has always been room for improvement and changes over the existing window operating assemblies.

For the reasons stated above and for other reasons stated below, which will become apparent to those skilled in the art upon reading and understanding the present specification, there is a need in the art for an improved window operating system.

BRIEF SUMMARY

The above-mentioned problems associated with prior devices are addressed by embodiments of the disclosure and will be understood by reading and understanding the present specification. The following summary is made by way of example and not by way of limitation.

In one embodiment, a window operating system moves a window sash between an open position and a closed position. A window has a top member operatively connected to a bottom member by a first side member and a second side member to form a frame. The sash is mounted to the frame for relative movement between the open and closed positions. The window operating system comprises an operator and an elongate member. The operator has a rotating member, and the elongate member provides rotational movement to the rotating member of the operator and movement of the elongate member rotates the rotating member thereby opening and closing the sash.

In one embodiment, a window operating system moves a window sash between an open position and a closed position. A window has a top member operatively connected to a bottom member by a first side member and a second side member to form a frame. The sash is mounted to the frame for relative movement between the open and closed positions. The window operating system comprises a top operator, a bottom operator, and an elongate member. The top operator has a top rotating member, and the bottom operator has a bottom rotating member. The elongate member connects the top and bottom rotating members, and movement of the elongate member rotates the top and bottom rotating members thereby opening and closing the sash.

In one embodiment, a window operating system moves a window sash between an open position and a closed position. A window has a top member operatively connected to a bottom member by a first side member and a second side member to form a frame. The sash is mounted to the frame for relative movement between the open and closed positions. The window operating system comprises an operator having a rotating member, an elongate member, and a first motor. The elongate member is adapted to provide rotational movement to the rotating member of the operator and movement of the elongate member rotates the rotating member thereby opening and closing the sash. The first motor is adapted to provide rotational movement to the rotating member of the operator thereby opening and closing the sash.

BRIEF DESCRIPTION OF THE DRAWINGS

The present disclosure can be more easily understood, and further advantages and uses thereof can be more readily apparent, when considered in view of the detailed description and the following Figures in which.

In accordance with common practice, the various described features are not drawn to scale but are drawn to emphasize specific features relevant to the present disclosure. Reference characters denote like elements throughout the Figures and the text.

DETAILED DESCRIPTION

Figure 1:
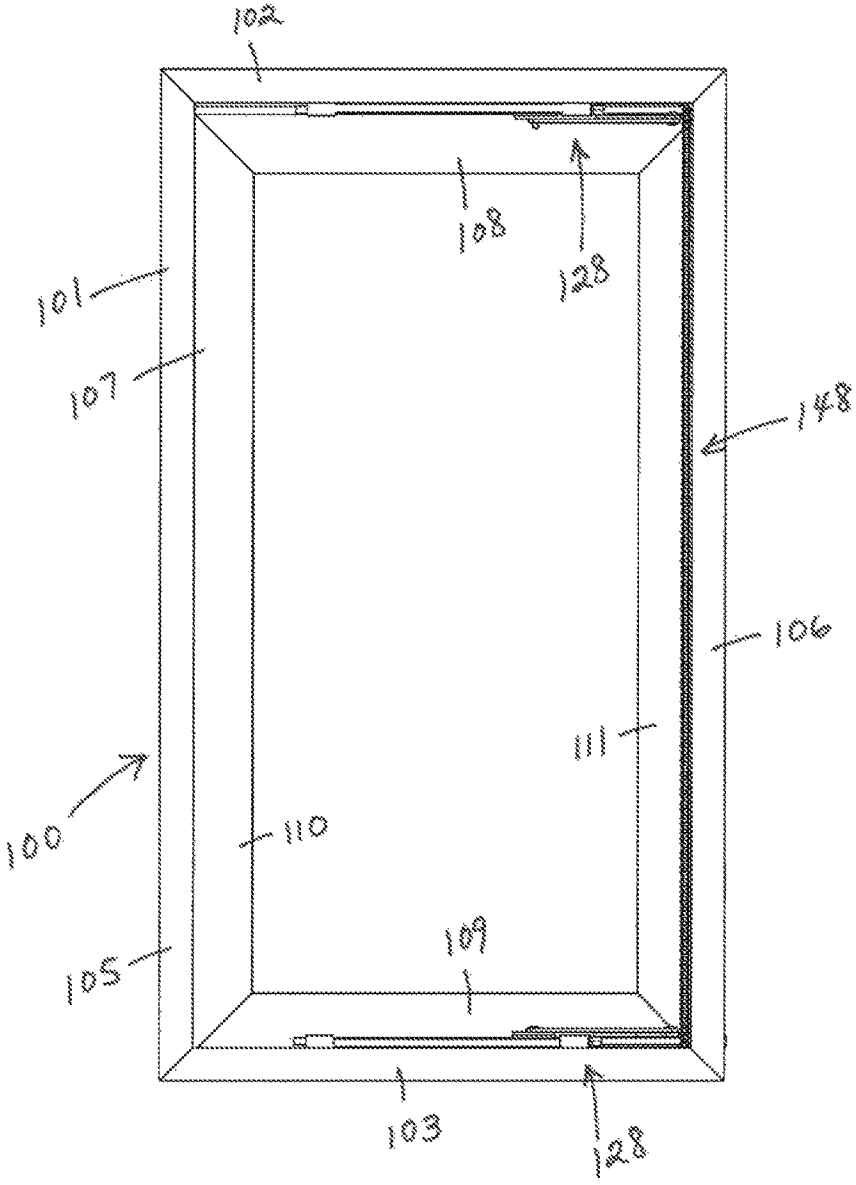
FIG. 1 is a front view of a window operating system constructed in accordance with the principles of the present invention connected to a casement window.
Figure 2:
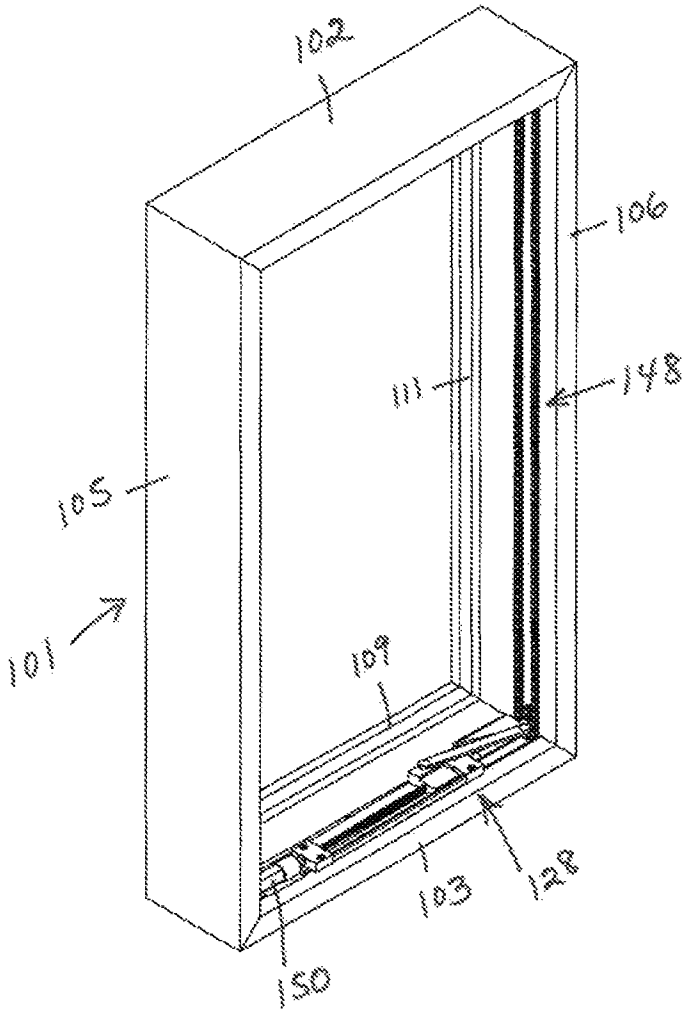
FIG. 2 is a front perspective view of the window operating system and the casement window shown in FIG. 1.

In the following detailed description, reference is made to the accompanying drawings, which form a part hereof, and in which is shown by way of illustration embodiments in which the disclosure may be practiced. It is to be understood that other embodiments may be utilized and mechanical changes may be made without departing from the spirit and scope of the present disclosure. The following detailed description is, therefore, not to be taken in a limiting sense.

Directional terminology such as "top", "bottom", "front", "rear", etc. is used with reference to the orientation of the Figure(s) being described. Because components of embodiments can be positioned in a number of different orientations, directional terminology is used for purposes of illustration and is in no way limiting.

Embodiments of the disclosure generally provide at least one operator assembly interconnecting a window frame 101 and a sash 107, and an elongate member operatively connected to at least one operator assembly. The window frame 101 is formed by a top member 102 operatively connected to a bottom member 103 by a first side member 105 and a second side member 106. The sash is formed by a top member 108 operatively connected to a bottom member 109 by a first side member 110 and a second side member 111. The sash 107 is mounted to the window frame 101 for relative movement between the open and closed positions. For example, the sash 107 could be moved in a controlled manner relative to the window frame 101 such that the sash 107 pivots, pivots and translates, pivots and slides, rotates, or otherwise moves relative to the window frame 101. Movement of the elongate member causes the at least one operator assembly to open or close the sash 107 relative to the window frame 101. The operator assembly could include a mechanism selected from the group consisting of a lead screw and a worm gear. The elongate member could be any suitable mechanism such as, but not limited to, a chain, a belt, a cable, a cord, etc. It is recognized that any suitable chain could be used, such as but not limited to, a ball chain, a roller chain, a link chain, a jack chain, a sash chain, etc. The elongate member could include one or more components. For example, a belt could be operatively connected to a ball chain.

This window operating system could eliminate the crank on a casement window and other components of the system could be hidden from view inside the casement window.

One or both of the top operator assembly and the bottom operator assembly could be used. For larger windows, using both the top operator assembly and the bottom operator assembly adds strength and stability to the system and makes it easier to open and close the sash. For smaller windows, an operator assembly could be positioned on either the top member 102 or the bottom member 103 of the window frame 101.

At least one motor could be added to the system. There could be a motor proximate the top and/or the bottom of the window frame and there could be more than one motor proximate the top and/or the bottom of the window frame. The motor(s) could allow for operation of the system utilizing a variety of actuating sources such as, but not limited to, a wall switch, a remote control, a mobile phone app, a home security system, a HVAC system, and other types of home automation systems. If there is a loss of power to the system, there could be a manual override. For example, the elongate member could be manually operated should there be a loss of power.

The elongate member assists in easy egress, for example emergency exit. For motor operated windows, the elongate member is exposed so that the motor can be overridden or otherwise disconnected and the window can be quickly opened during loss of power or an emergency.

In one embodiment, illustrated in FIGS. 1-6, an operator assembly includes a top operator assembly 128 and a bottom operator assembly 128, and the elongate member 148 is illustrated as a chain to open and close a sash 107 relative to a frame 101 of a casement window assembly 100.

The sash 107 is pivotally connected to the frame 101 with a hinge swivel arm 118 proximate the top member 102 and a hinge swivel arm 118 proximate the bottom member 103 of the frame 101. A first end 119 of the hinge swivel arm 118 is pivotally connected to the frame 101 and a second end 120 of the hinge swivel arm 118 is pivotally connected to the sash 107 as is well known in the art. The operator assemblies 128 are operatively connected to the top and bottom members 102 and 103 of the frame 101. Each operator assembly 128 includes a lead screw 132 with a threaded section along which a threaded nut 135 travels. Although operator assembly 128 is shown and described, it is recognized that other types of operator assemblies could be used. An arm 115 interconnects the threaded nut 135 and a sash bracket 114 connected to the sash 107. A first end 116 of the arm 115 is pivotally connected to the nut 135, and a second end 117 of the arm 115 is pivotally connected to the sash bracket 114. The lead screw 132 includes a first end 133 and a second end 134, and each end is inserted through a bore of a block, and the blocks 129 and 136 are secured to the frame 101. The blocks 129 and 136 are shown secured with screws but could be secured with any suitable fastener or securing means. The lead screw 132 is rotatable within the bores of the blocks 129 and 136. A track 137 positioned between the blocks 129 and 136 opposes forces perpendicular to the leadscrew length and assists in keeping the nut 135 steady as it travels along the lead screw 132. An L-shaped bracket 122 could be used to connect the hinge swivel arm 118 to the frame 101 and allows the hinge shoe to slide along its length during operation. A guide member 121 is operatively connected to the sash 107 and moves along the L-shaped bracket 122. A connector 138 operatively connects the second end 134 of the lead screw 132 to a rod 139, which is operatively connected to a sprocket 140. The sprocket 140 includes a plurality of teeth 141 configured and arranged to extend through openings in the elongate member 148.

Figure 3A:
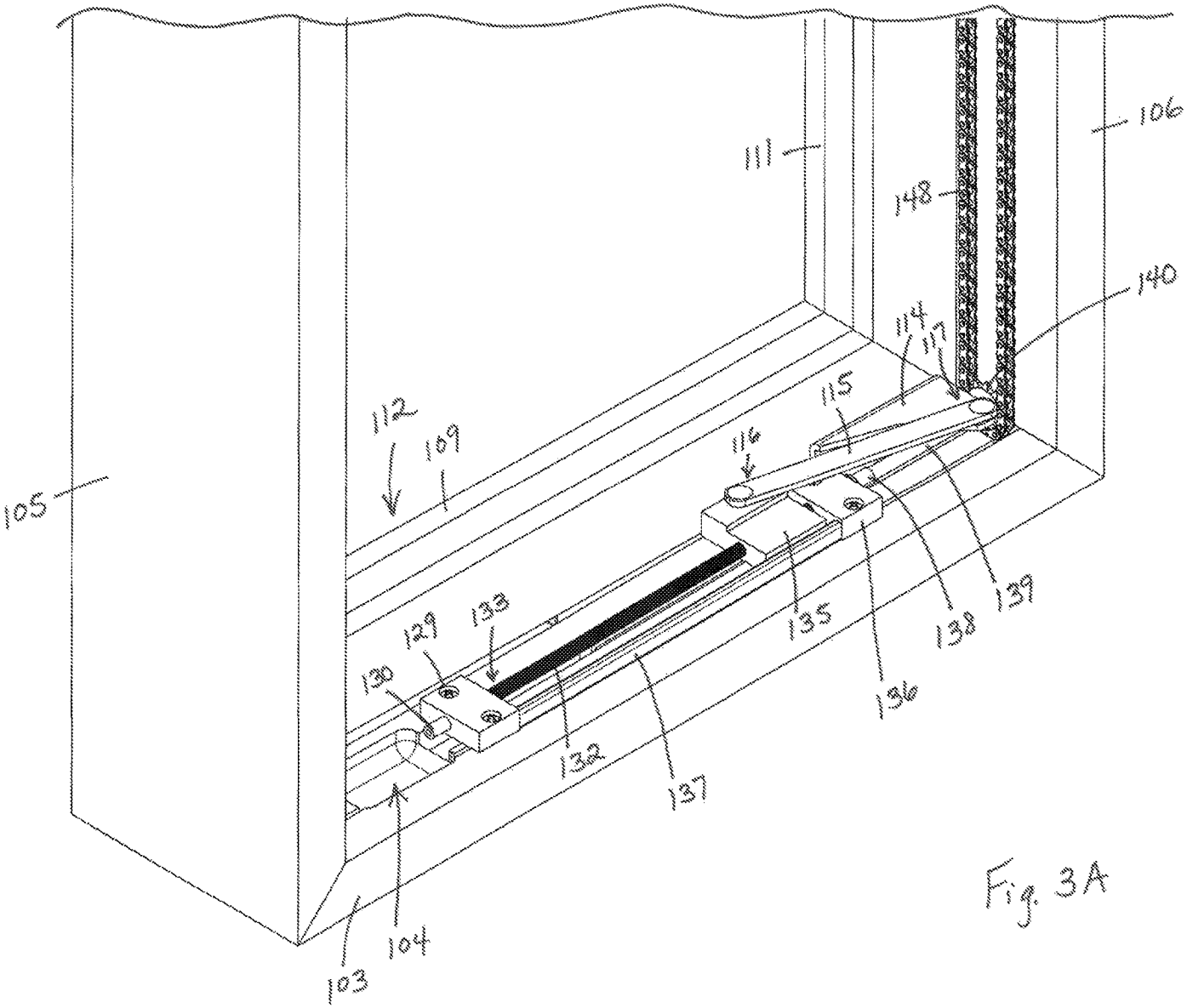
FIG. 3A is a front perspective view of portions of the window operating system and the casement window shown in FIG. 2 in a closed position.
Figure 3B:
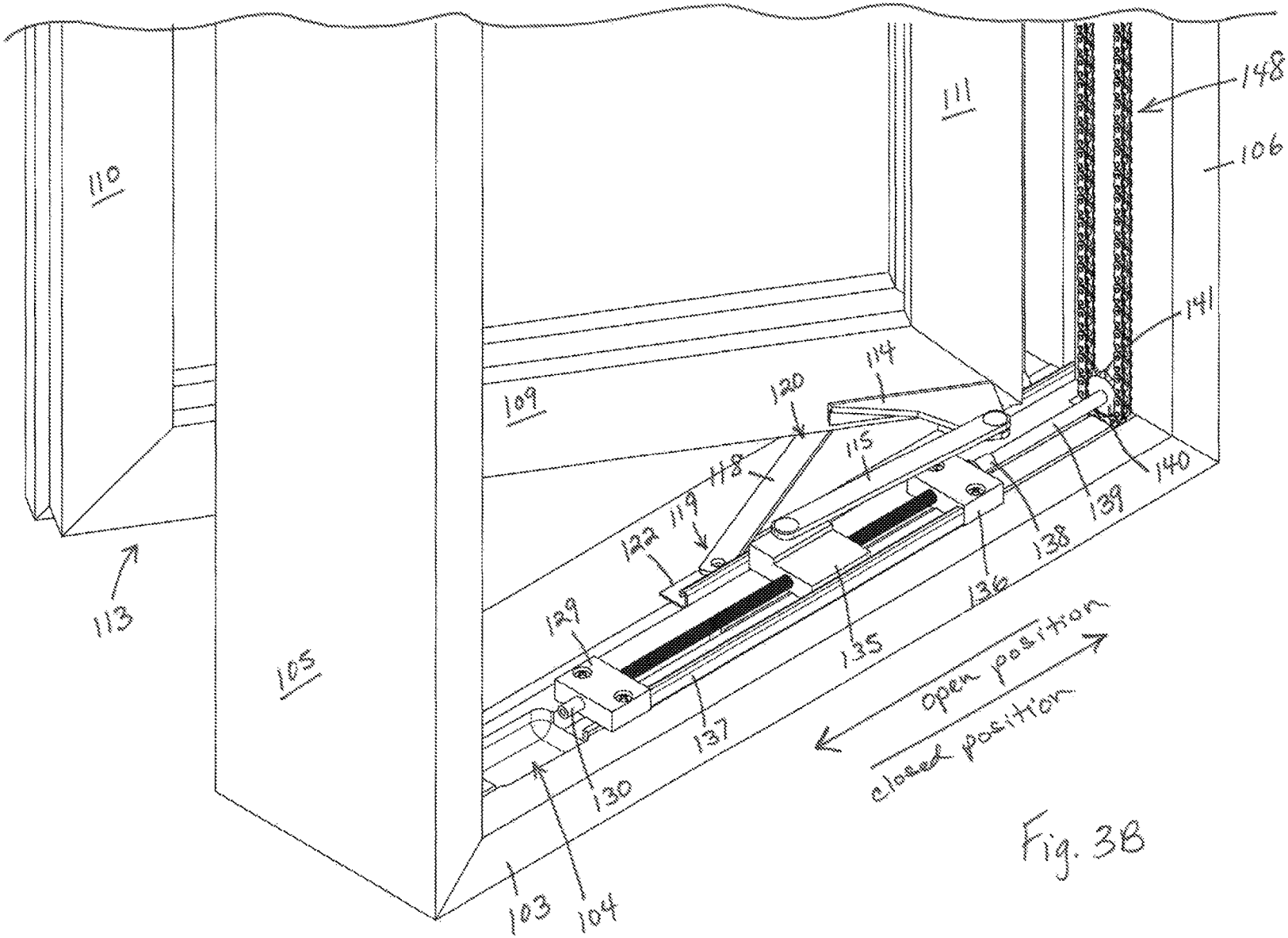
FIG. 3B is a front perspective view of portions of the window operating system and the casement window shown in FIG. 2 in an open position.
Figure 5:
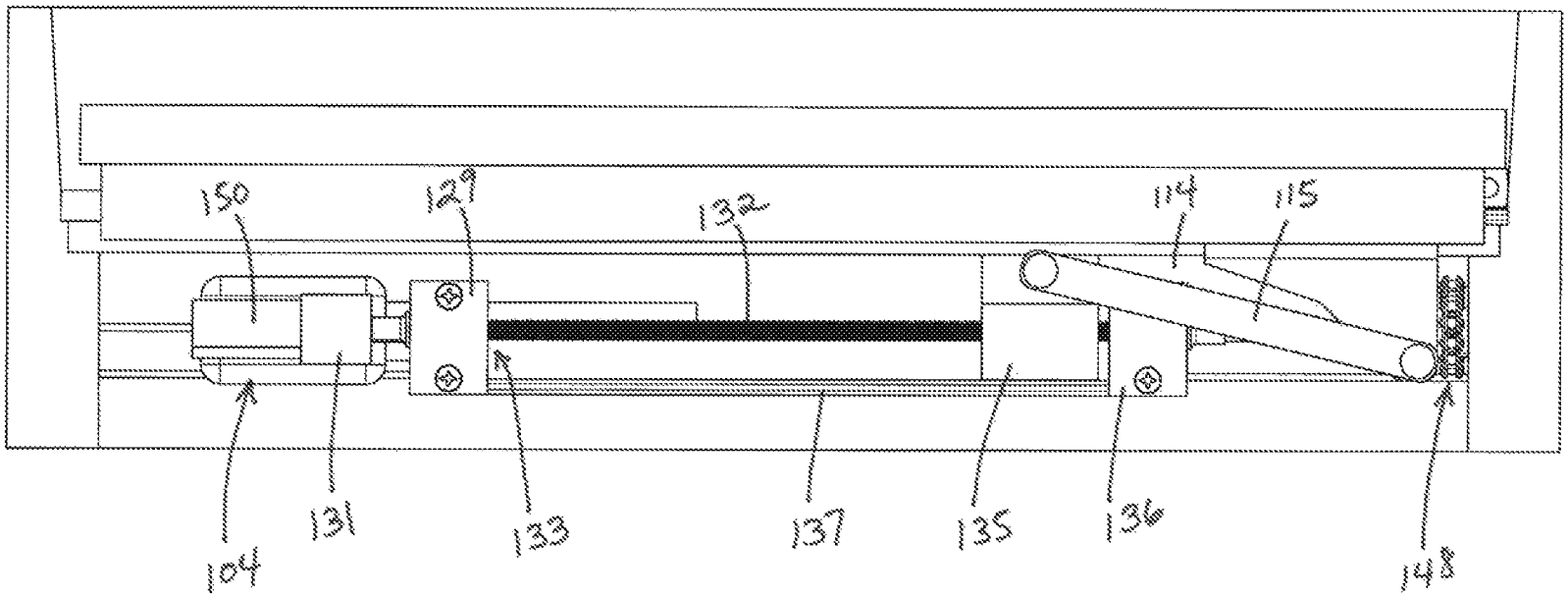
FIG. 5 is a top view of the window operating system and the casement window shown in FIG. 3A with a top member of the casement window removed.
Figure 6:
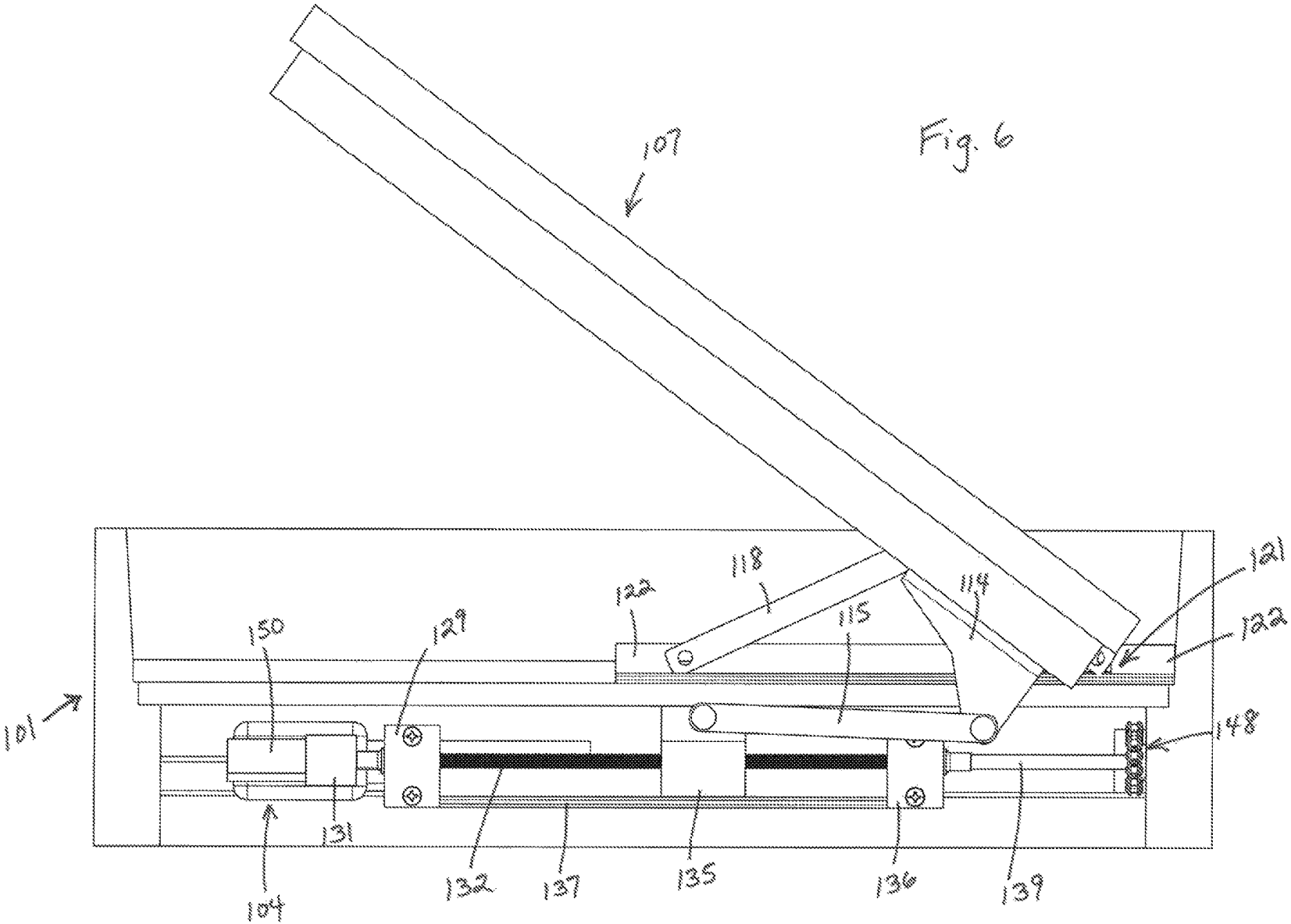
FIG. 6 is a top view of the window operating system and the casement window shown in FIG. 3B with a top member of the casement window removed.

The elongate member 148 engages the sprockets 140 of the top and bottom operator assemblies 128. Although the sprockets 140 and the elongate member 148 are shown positioned on the second side member 106 of the frame 101, the system could be reversed so that the sprockets 140 and the elongate member 148 are positioned on the first side member 105 of the frame 101. As the elongate member 148 is moved, either up or down relative to the window frame 101, the gears 140 rotate. Rotation of the gears 140 causes rotation of the rods 139 and thus the lead screws 132, and rotation of the lead screws 132 causes the nuts 135 to travel along the lead screws 132 to open and close the sash 107. The elongate member 148 is configured and arranged to provide rotational movement to the rotating member (e.g., sprocket 140, rod 139, lead screw 132) of the operator 128, and movement of the elongate member 148 rotates the rotating member thereby opening and closing the sash. As illustrated in FIGS. 3B and 6, movement of the nut 135 toward the first end 133 of the lead screw 132 positions the sash 107 in an open position 113 and, as illustrated in FIGS. 3A and 5, movement of the nut 135 toward the second end 134 of the lead screw 132 positions the sash 107 in a closed position 112.

Figure 4:
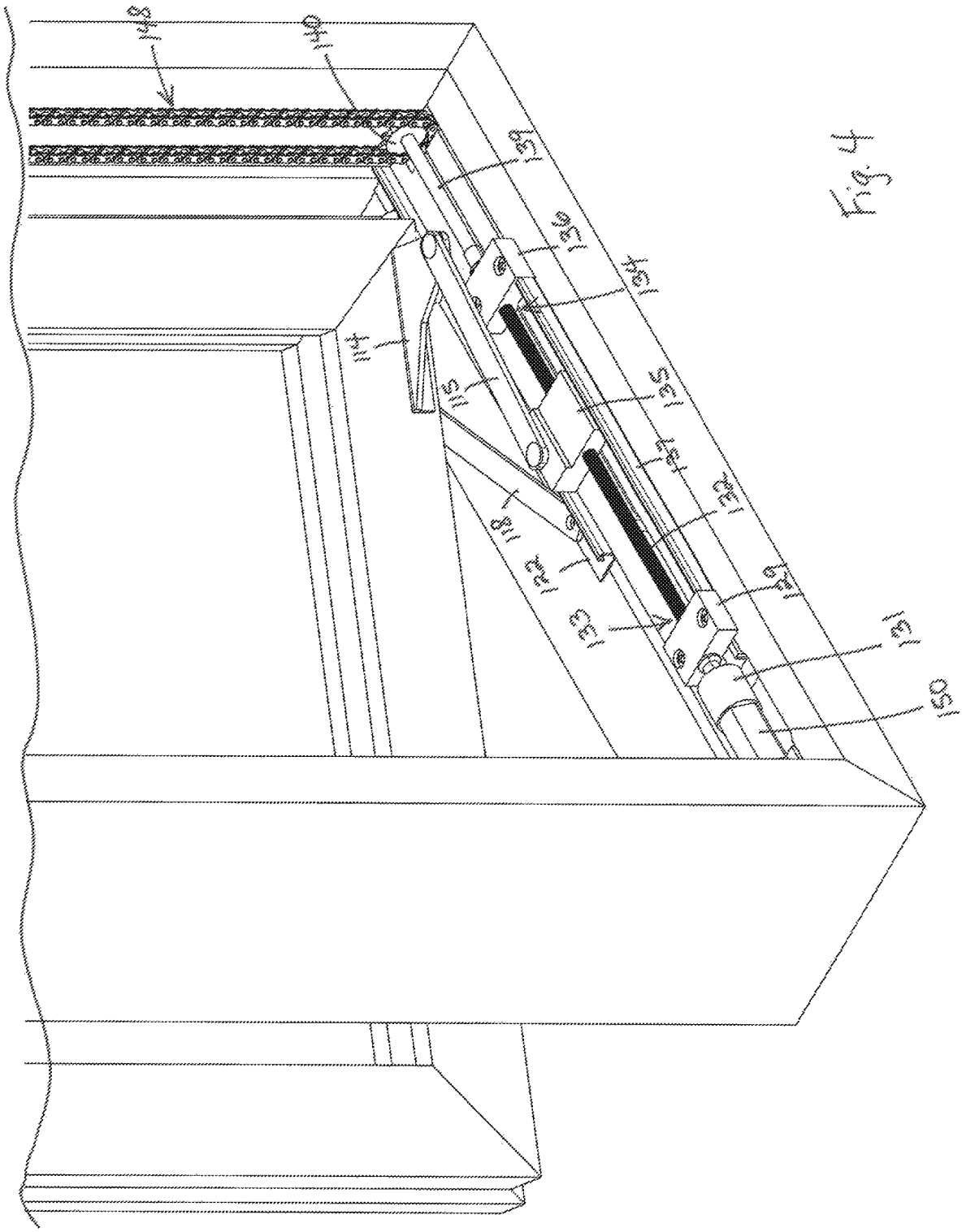
FIG. 4 is a front perspective view of portions of the window operating system and the casement window shown in FIG. 3B with a motor.

Optionally, as illustrated in FIG. 4, the first end 133 of the lead screw 132 could include a connector 130 extending through the bore in the block 129, and the connector 130 receives a motor shaft of a motor 150 thereby interconnecting the motor shaft and the lead screw 132. Rotation of the motor shaft causes the lead screw 132 to rotate. The motor 150 optionally includes a gear box 131. The window frame 101 could include a recessed area 104 to receive the motor 150.

Figure 8:
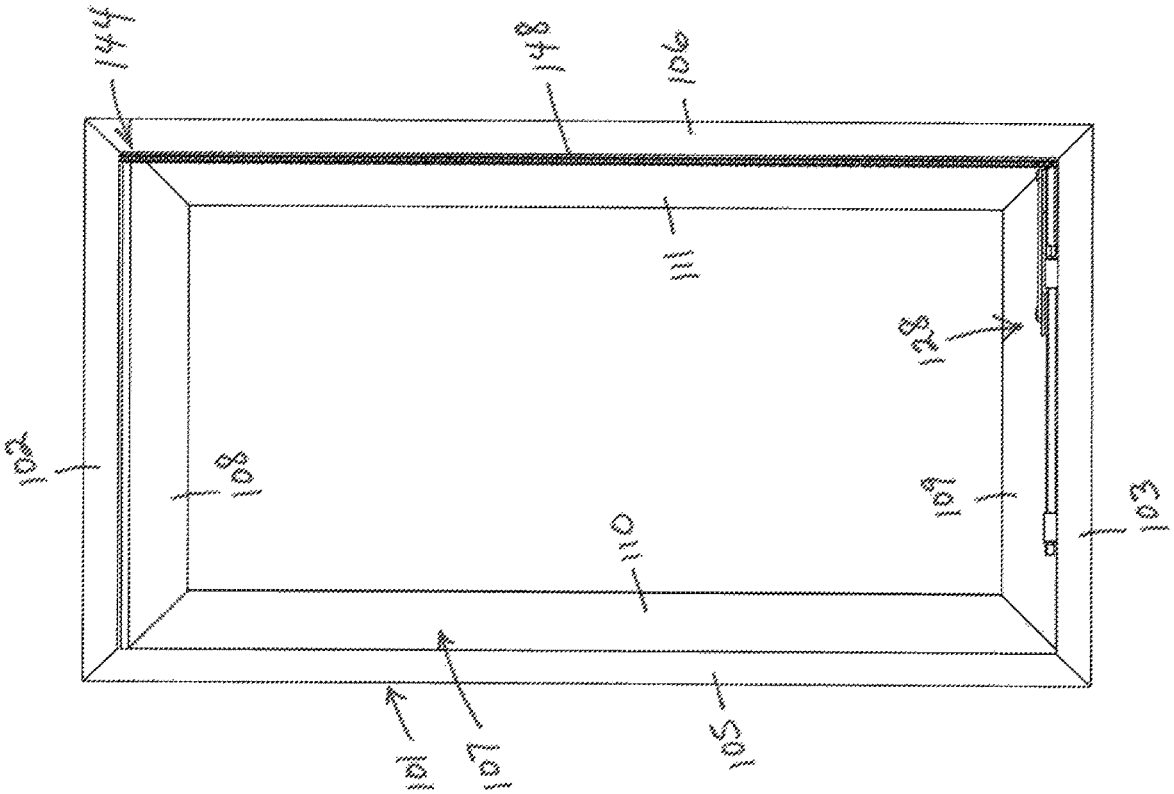
FIG. 8 is a front view of another embodiment window operating system constructed in accordance with the principles of the present invention connected to a casement window in a closed position.

In one embodiment, illustrated in FIG. 8, the operator assembly includes a bottom operator assembly 128, and the elongate member 148 is illustrated as a chain. This embodiment is similar to the embodiment illustrated in FIGS. 1-6 but without the top operator assembly. Because there is no top operator assembly, the top gear of the embodiment illustrated in FIGS. 1-6 is substituted with a pulley 144. The operator assembly 128 could be positioned to position the elongate member 148 and the pulley 144 in any suitable location along either side of the frame 101.

Figure 9:
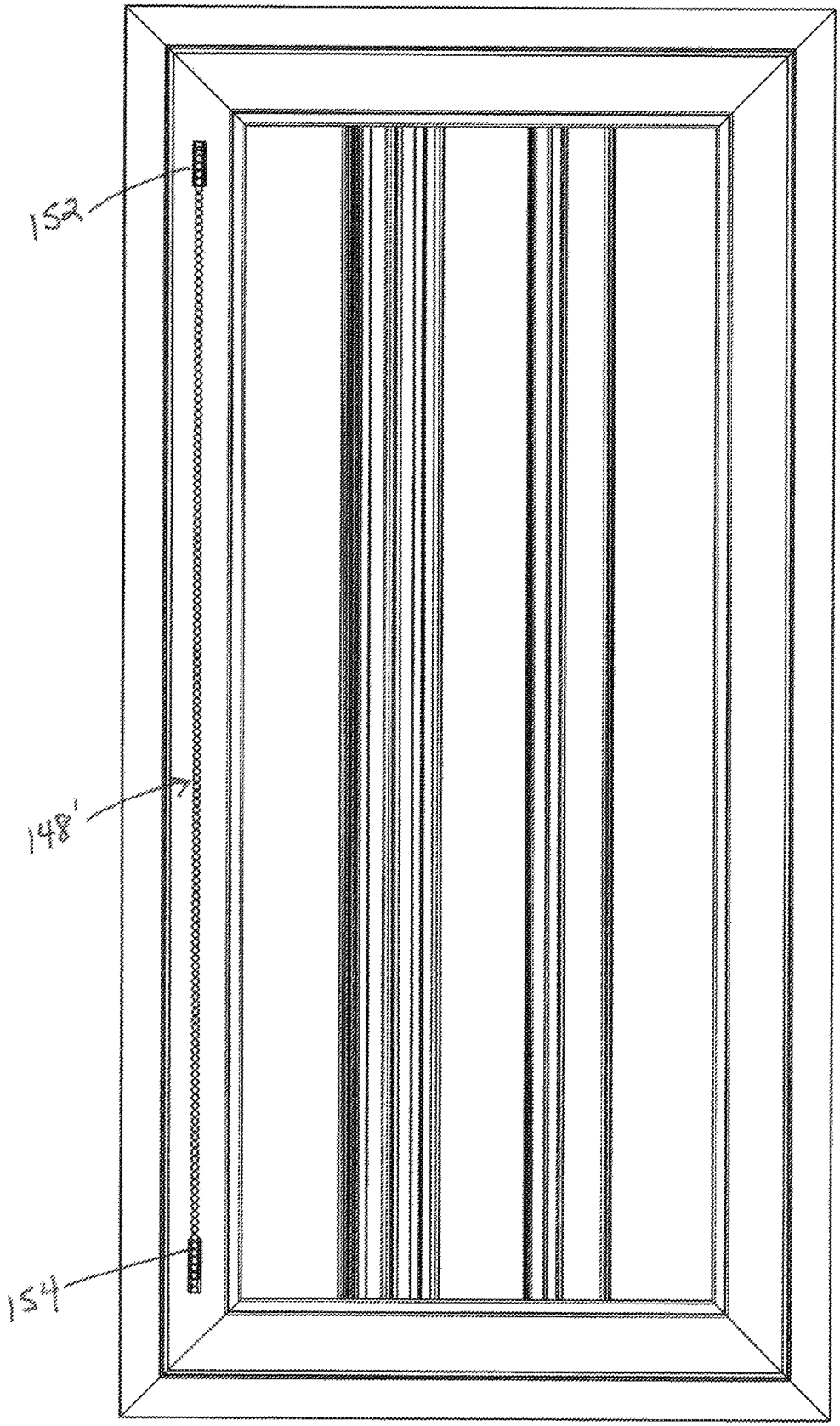
FIG. 9 is a front view of another embodiment window operating system constructed in accordance with the principles of the present invention connected to a casement window in an open position.
Figure 10:
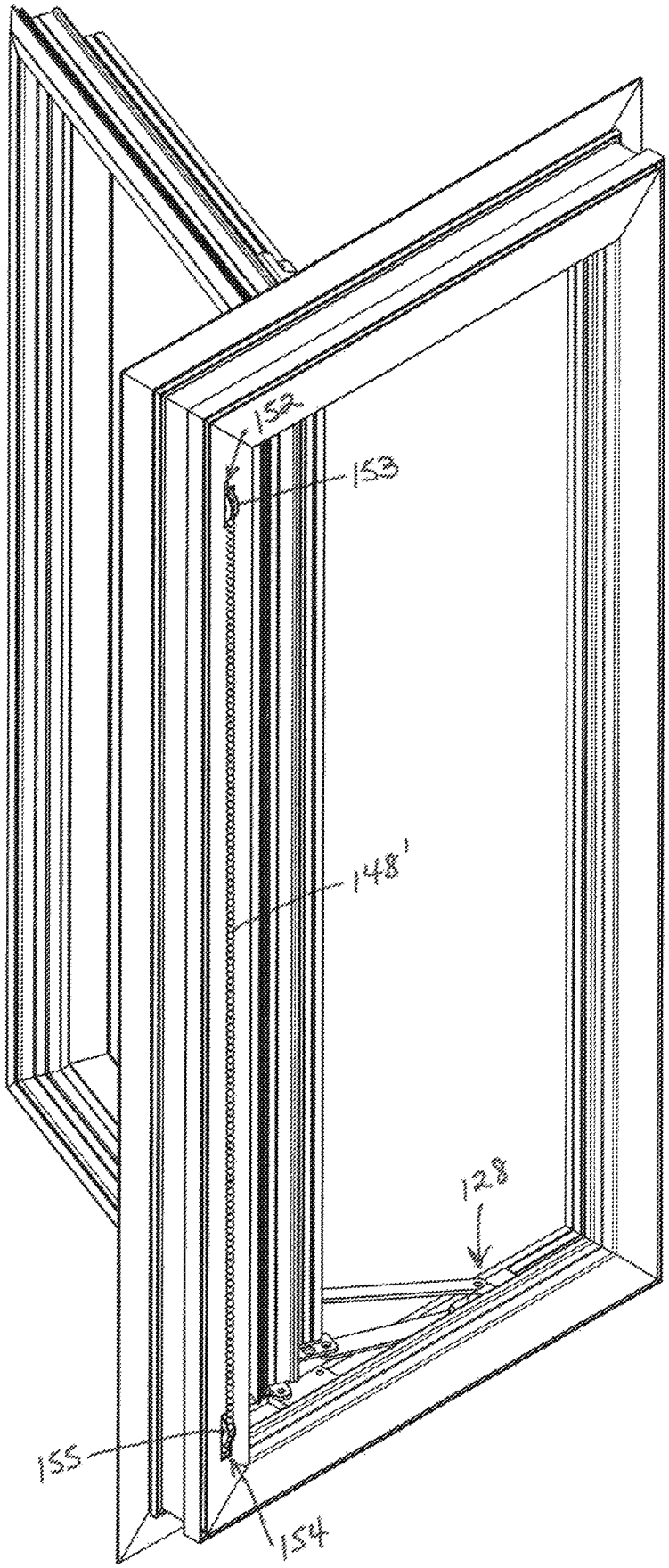
FIG. 10 is a front perspective view of the window operating system and the casement window shown in FIG. 9.
Figure 11:
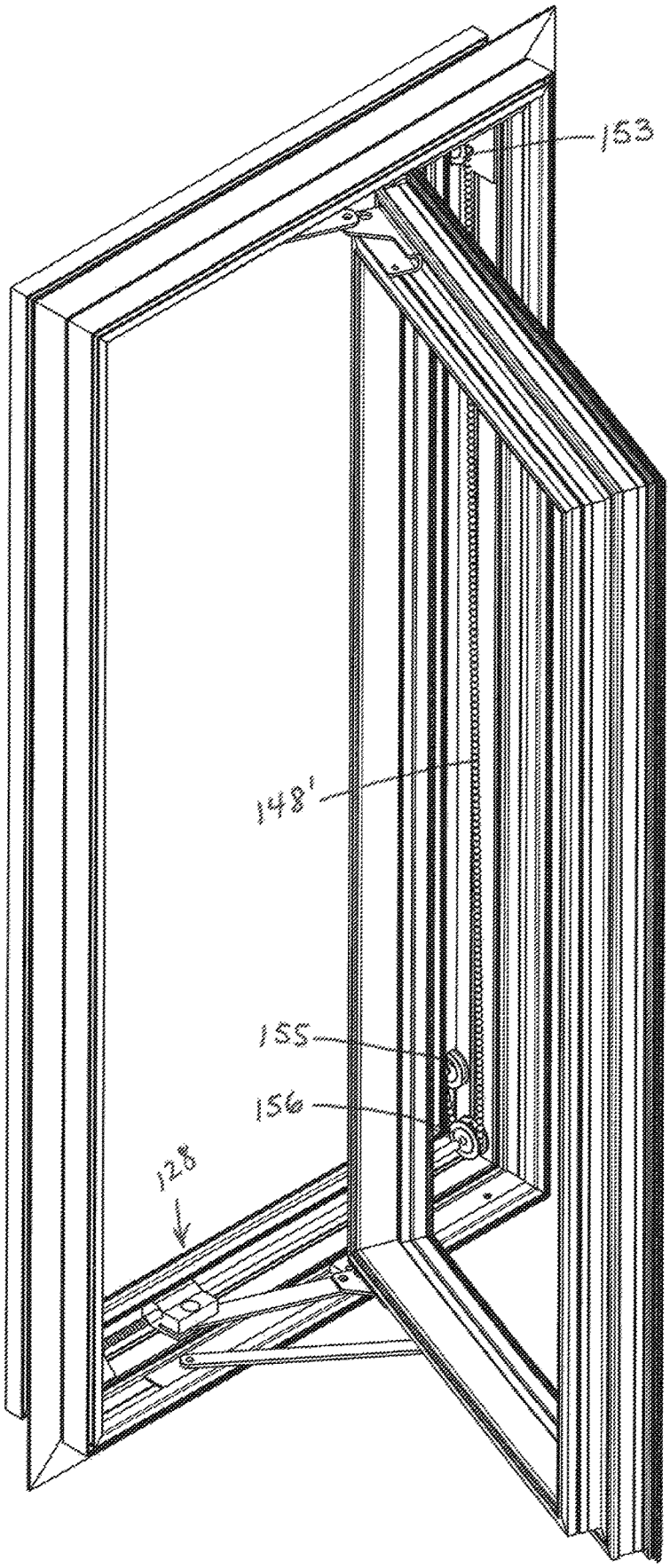
FIG. 11 is a rear perspective view of the window operating system and the casement window shown in FIG. 9.
Figure 12:
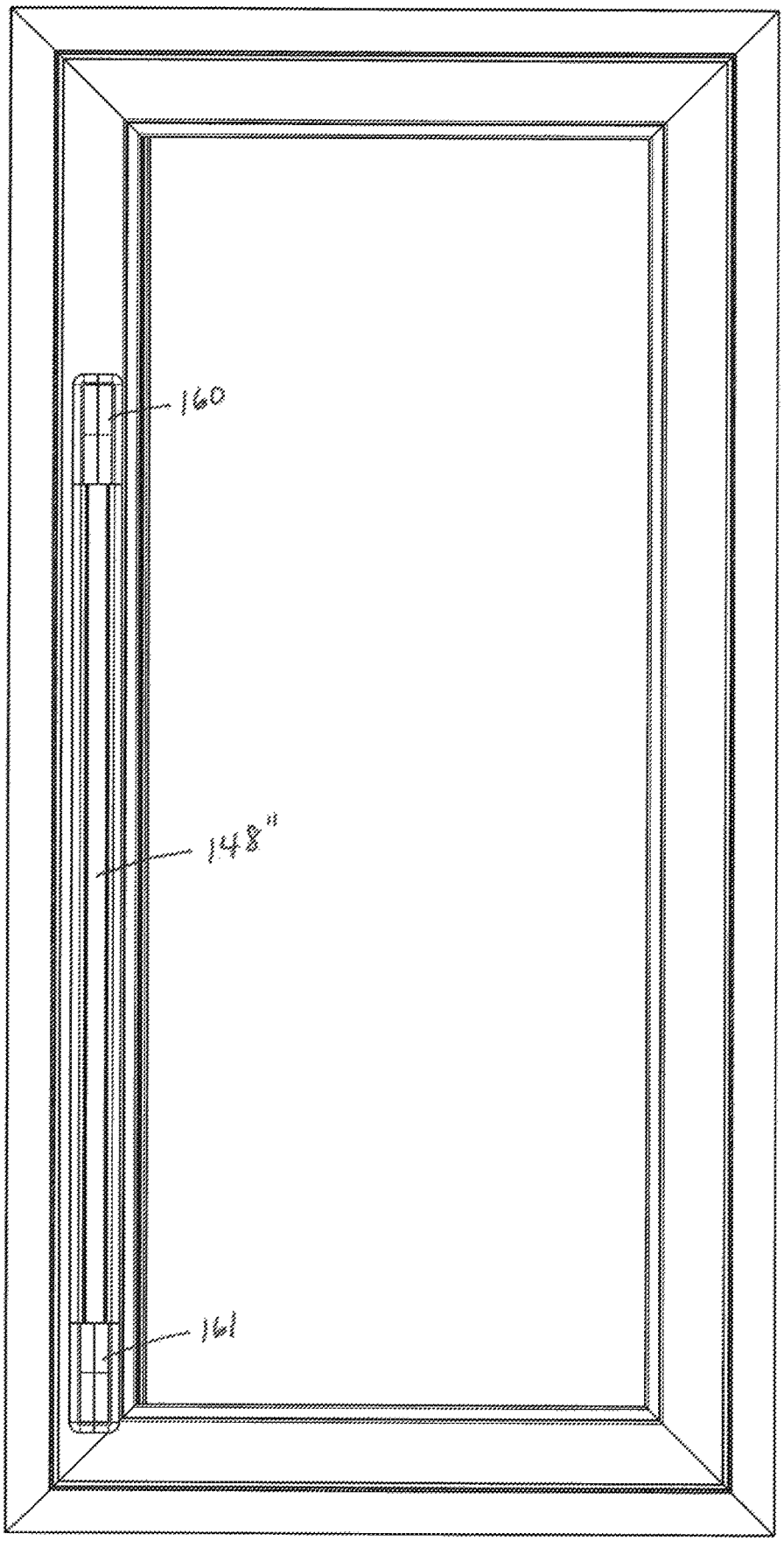
FIG. 12 is a front view of another embodiment window operating system constructed in accordance with the principles of the present invention connected to a casement window in a closed position.
Figure 13:
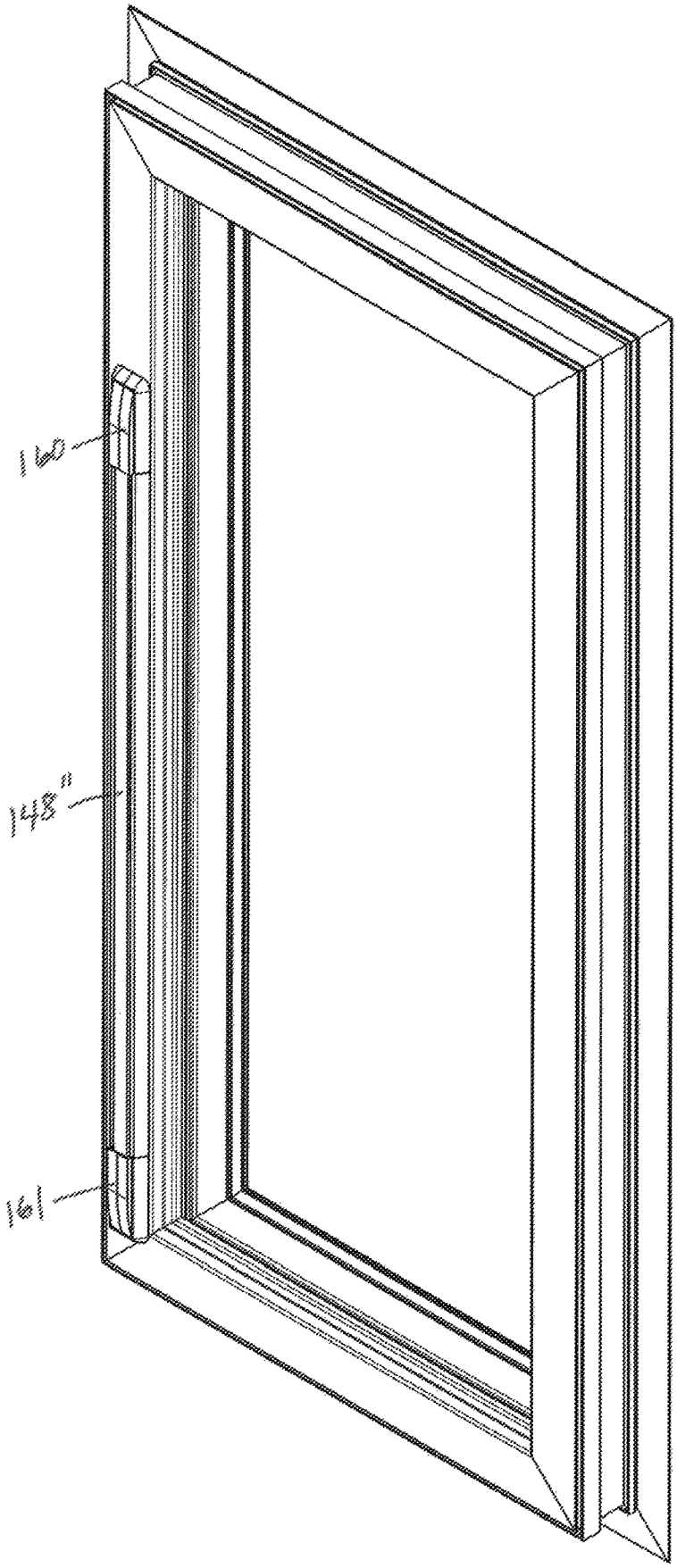
FIG. 13 is a front perspective view of the window operating system and the casement window shown in FIG. 12.
Figure 14:
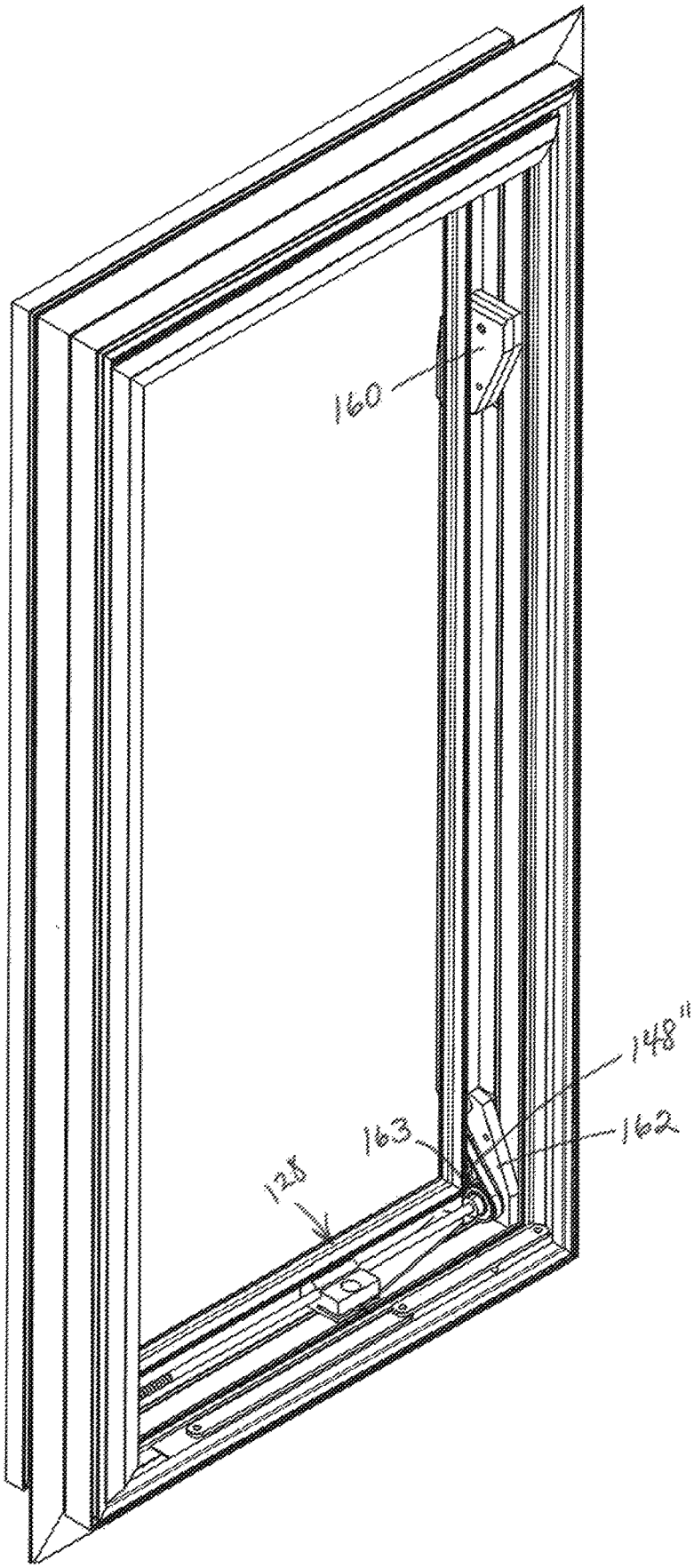
FIG. 14 is a rear perspective view of the window operating system and the casement window shown in FIG. 12 in a closed position.
Figure 15:
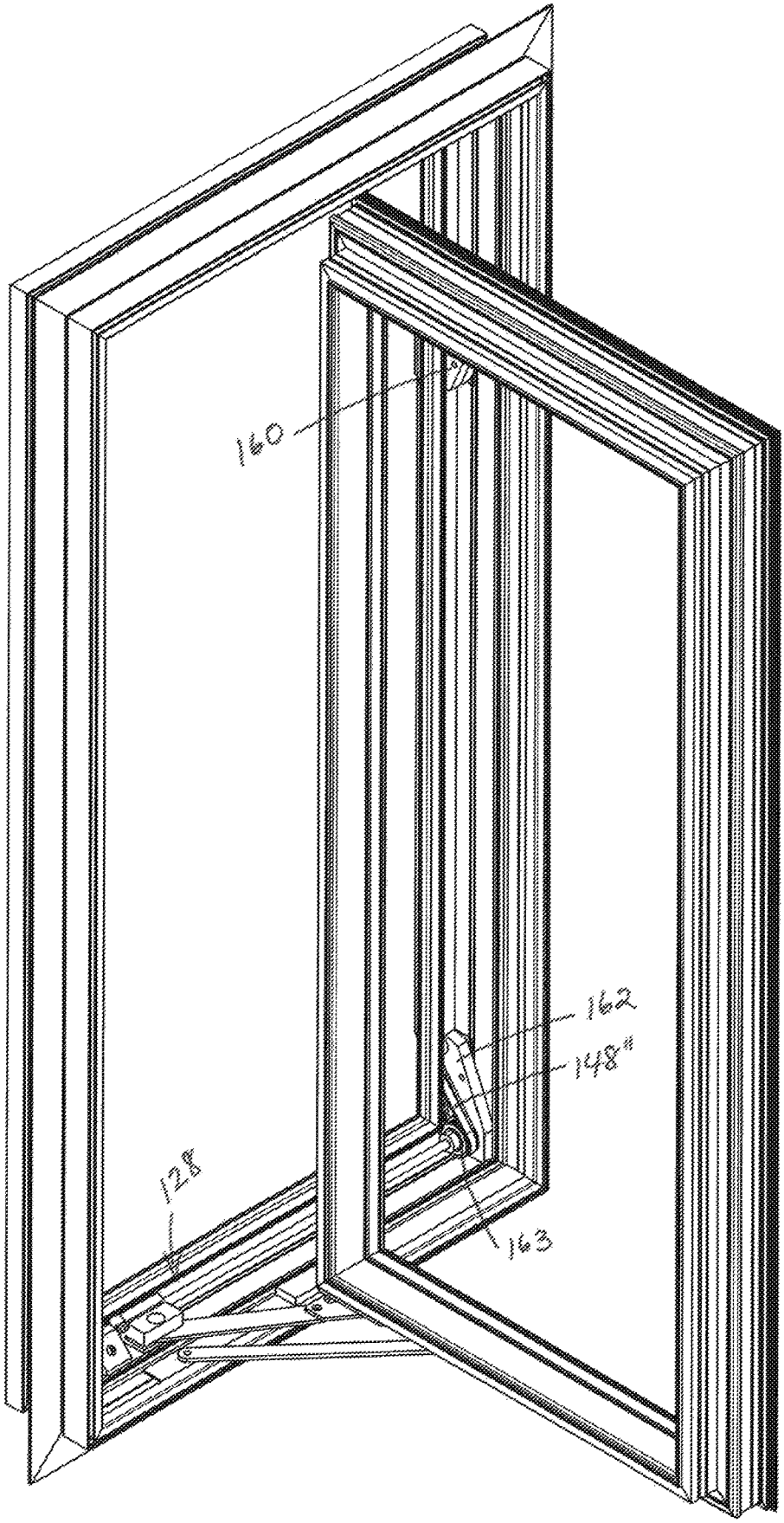
FIG. 15 is a rear perspective view of the window operating system and the casement window shown in FIG. 12 in an open position.
Figure 16:
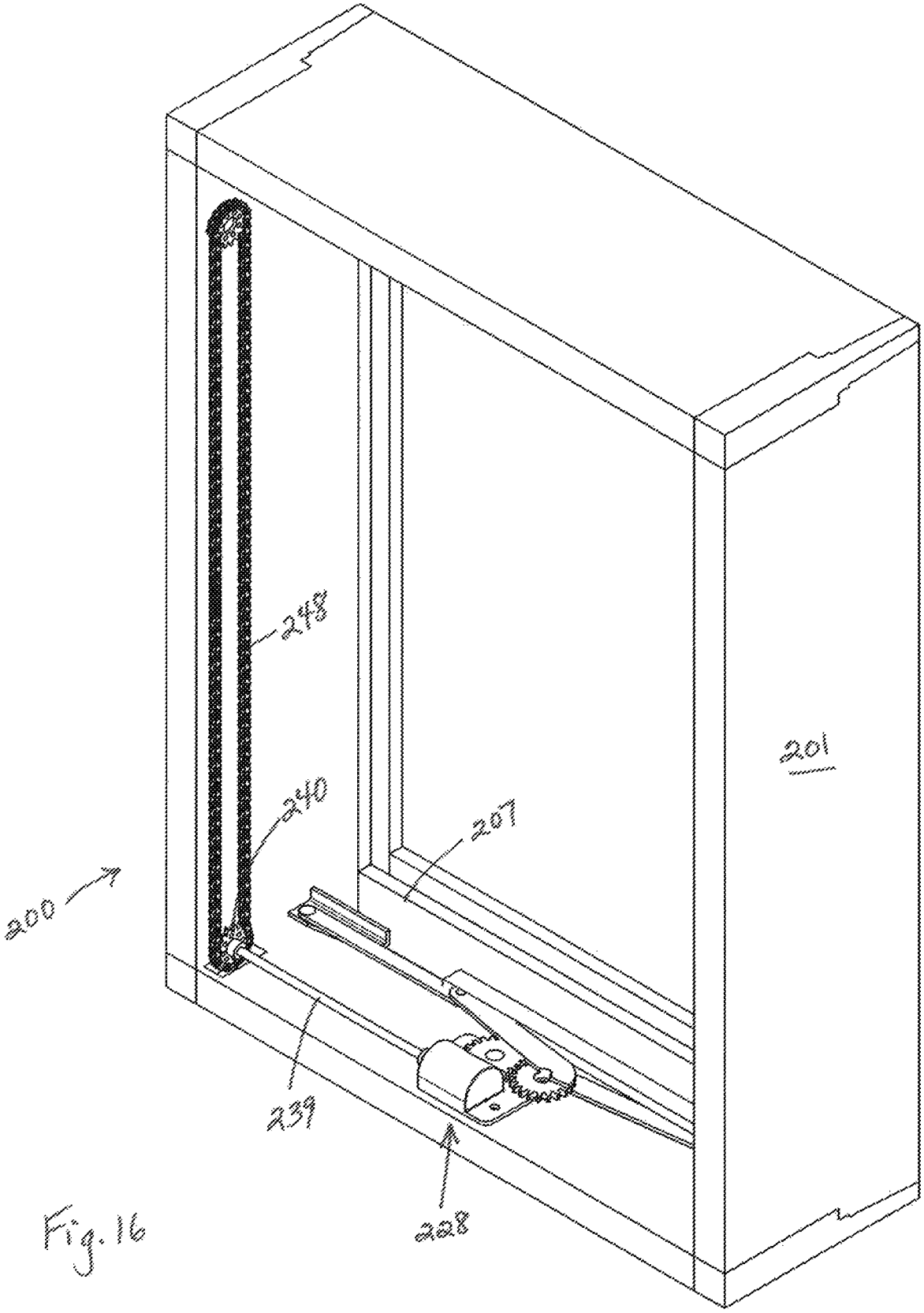
FIG. 16 is a front perspective view of another embodiment window operating system constructed in accordance with the principles of the present invention connected to a casement window in a closed position.
Figure 17:
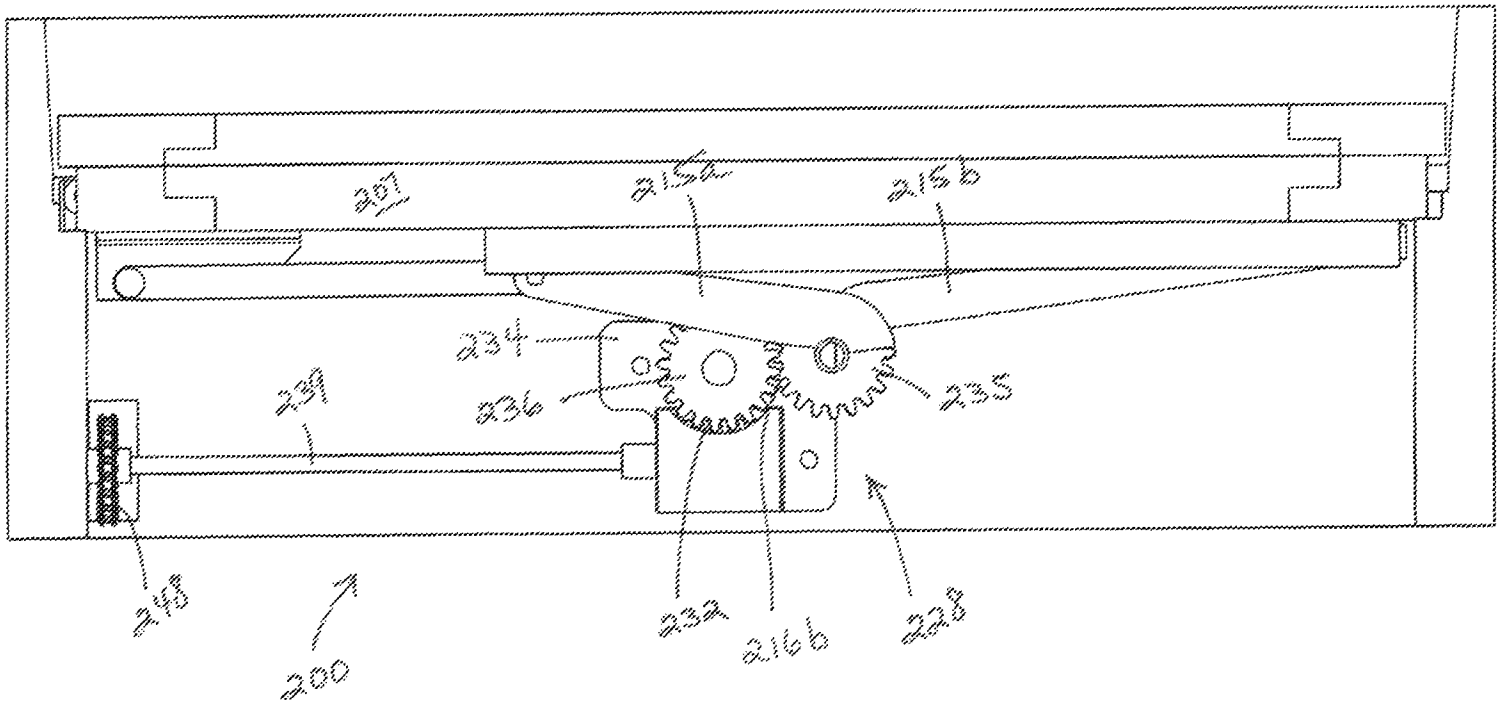
FIG. 17 is a top view of the window operating system and the casement window shown in FIG. 16 with the top of the frame removed.
Figure 18:
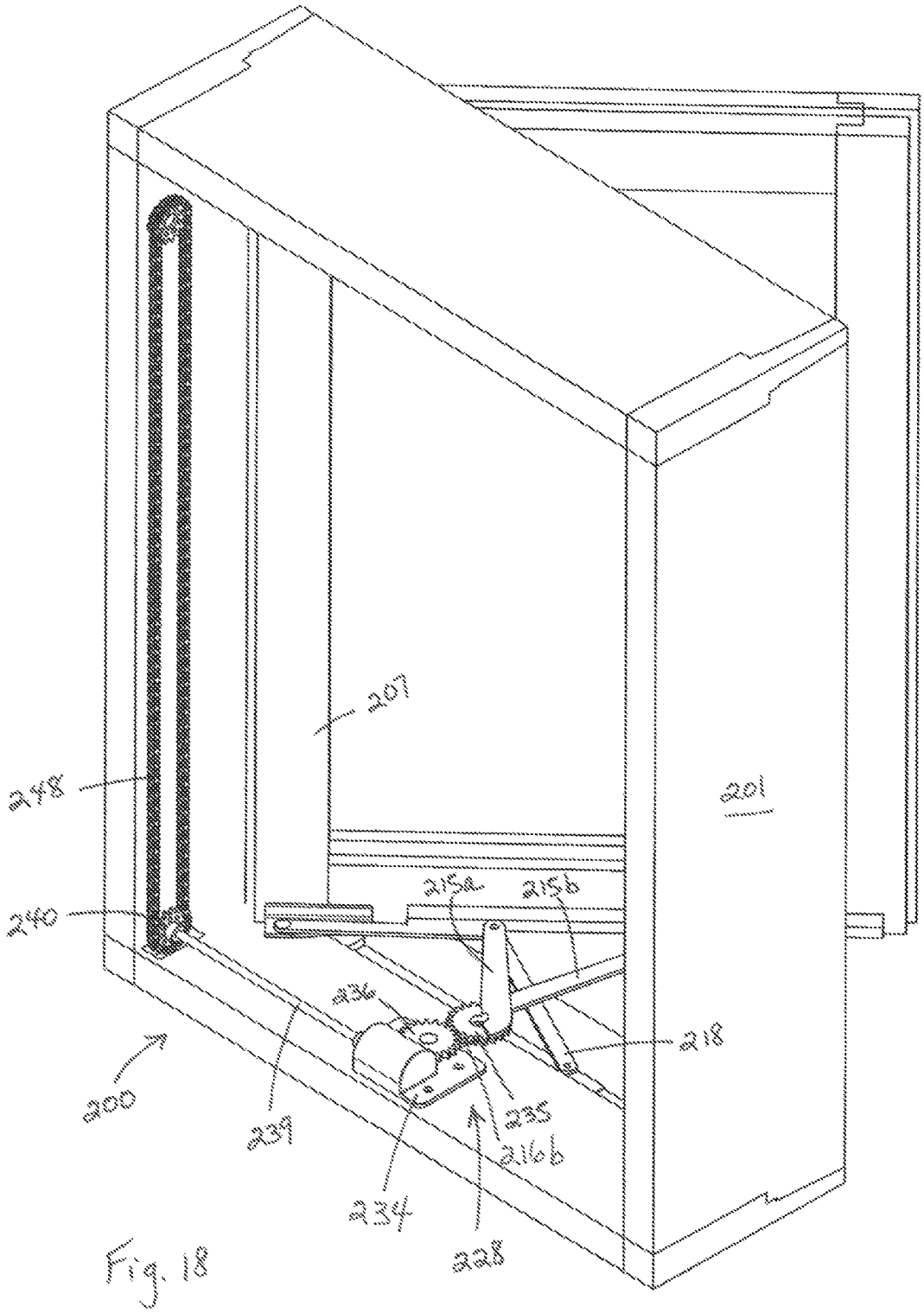
FIG. 18 is a front perspective view of the window operating system and the casement window shown in FIG. 16 in an open position.
Figure 19:
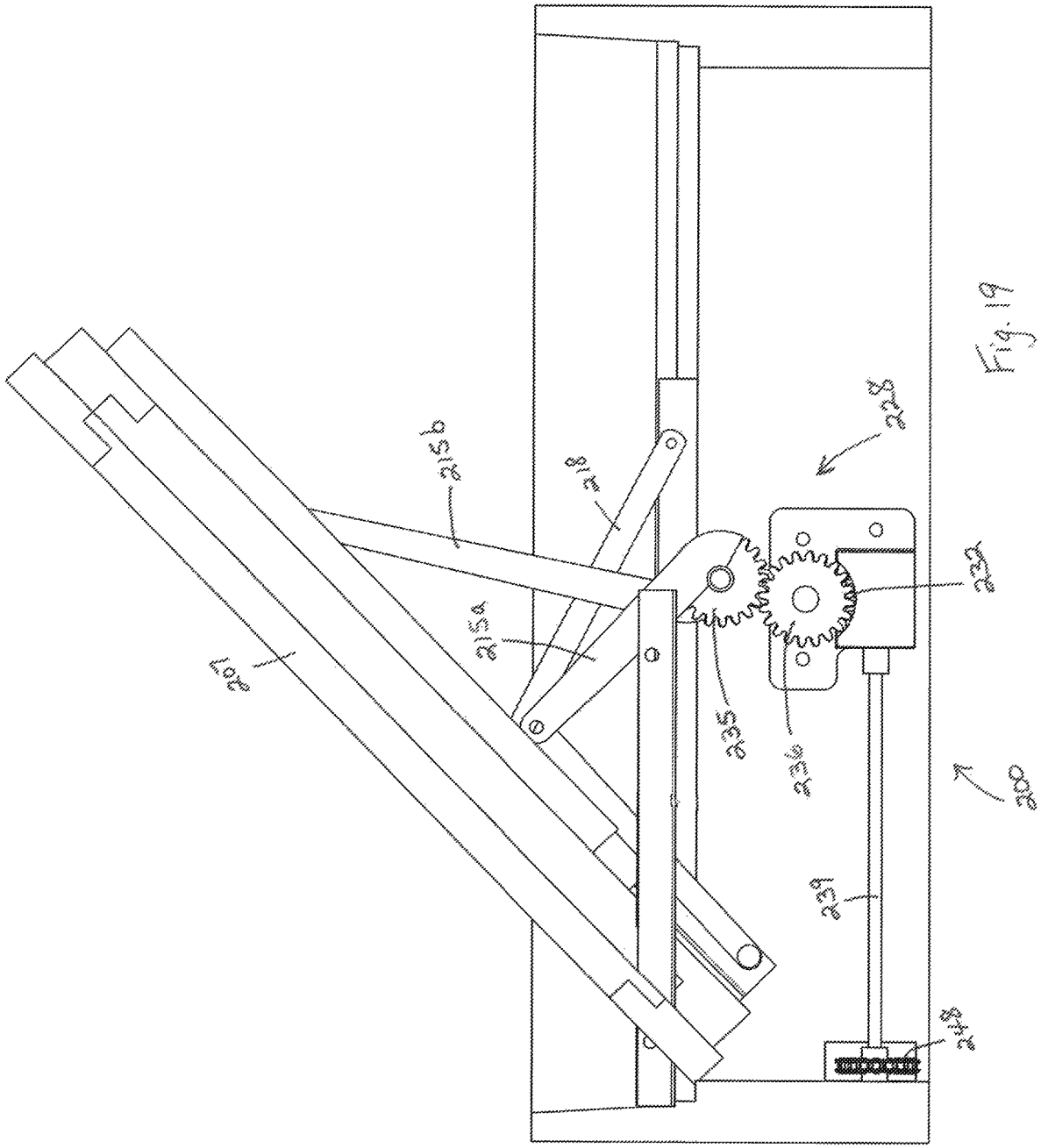
FIG. 19 is a top view of the window operating system and the casement window shown in FIG. 18 with the top of the frame removed.

In one embodiment, illustrated in FIGS. 9-11, the operator assembly includes a bottom operator assembly 128, and the elongate member 148' is illustrated as a ball chain. This embodiment is similar to the embodiment illustrated in FIG. 8. However, the gear 140 connected to the operator assembly of the embodiment illustrated in FIG. 8 is substituted with a drive pulley 156. The drive pulley 156 includes splines to engage the ball chain between the ball portions. A top pulley 153 and a bottom pulley 155 could be positioned within a top aperture 152 and a bottom aperture 154, respectively, in the frame 101 proximate the top and the bottom of the frame 101 so that a portion of the ball chain is positioned outside of the frame 101. The top and bottom pulleys 153 and 155 could also be drive pulleys. The operator assembly 128 could be positioned to position the elongate member 148' and the top and bottom pulleys 153 and 155 in any suitable location along either side of the frame 101.

In one embodiment, illustrated in FIGS. 12-15, the operator assembly includes a bottom operator assembly 128, and the elongate member 148" is illustrated as a belt. This embodiment is similar to the embodiment illustrated in FIG. 8. However, the gear 140 connected to the operator assembly of the embodiment illustrated in FIG. 8 is substituted with a drive pulley 163. The drive pulley 163 engages the belt. A top pulley within a top pulley housing 160 and a bottom pulley within a bottom pulley housing 161 operatively connected to a belt guide 162 could be positioned within slots in the frame 101 proximate the top and the bottom of the frame 101 so that a portion of the belt is positioned outside of the frame 101. The top pulley could also be a drive pulley. The operator assembly 128 could be positioned to position the elongate member 148" and the top and bottom pulleys in any suitable location along either side of the frame.

In one embodiment, illustrated in FIGS. 16-19, a casement window assembly 200 includes an operator assembly 228. Similar to the other embodiments, the operator assembly 228 is operatively connected to a sprocket 240 and a rod 239 that move in response to movement of an elongate member 248. The operator assembly 228 includes a worm 232, which moves in response to movement of the rod 239, and causes rotation of a first gear 236. Arm 215*a* is a two link arm that connects to a sash bracket, and arm 215*b* is a straight arm that connects to a sash track. The first link of arm 215*a* includes a second gear 235 that is pivotally connected to arm 215*b* via a pin (not shown) that extends through an aperture in the second gear 235 and through an aperture (not shown) in the arm 215*b*. The arm 215*b* includes an extension 216*b* extending from proximate the second gear 235 to proximate the first gear 236, and a pin (not shown) operatively connected to plate 234 extends through an aperture (not shown) in the extension 216*b* and through an aperture in the first gear 236. Therefore, the arm 215*b* interconnects the first and second gears 236 and 235. The arms 215*a* and 215*b* are pivotally connected to the sash 207 and the arm 215*b* is operatively connected to the first gear 236 and the second gear 235 formed on the end of 215*a*, which mates with the first gear 236 and moves about the first gear 236 to open and close the sash 207 relative to the frame 201. Therefore, movement of the elongate member 248 moves the gear 240, which moves the rod 239, which moves the worm 232. The worm 232 is threaded to engage teeth of the first gear 236 and as the worm 232 moves, the first gear 236 rotates. The second gear 235 has teeth that engage the teeth of the first gear 236 so that it moves about the first gear 236, and movement of the second gear 235 about the first gear 236 moves the arms 215*a* and 215*b* to move the sash 207 relative to the frame 201. The dual arm operator mechanism (i.e., arms 215*a* and 215*b* and gears 235, and 236) is well known in the art. The operator assembly 228 configuration of the present invention may be used to eliminate the well known use of a manual handle and allows for hidden operation with rotary motion parallel to the length of the sill. This rotary motion may be provided by a hidden motor mounted in the frame or other mechanism providing rotary motion such as by an elongate member.

Figure 7A:
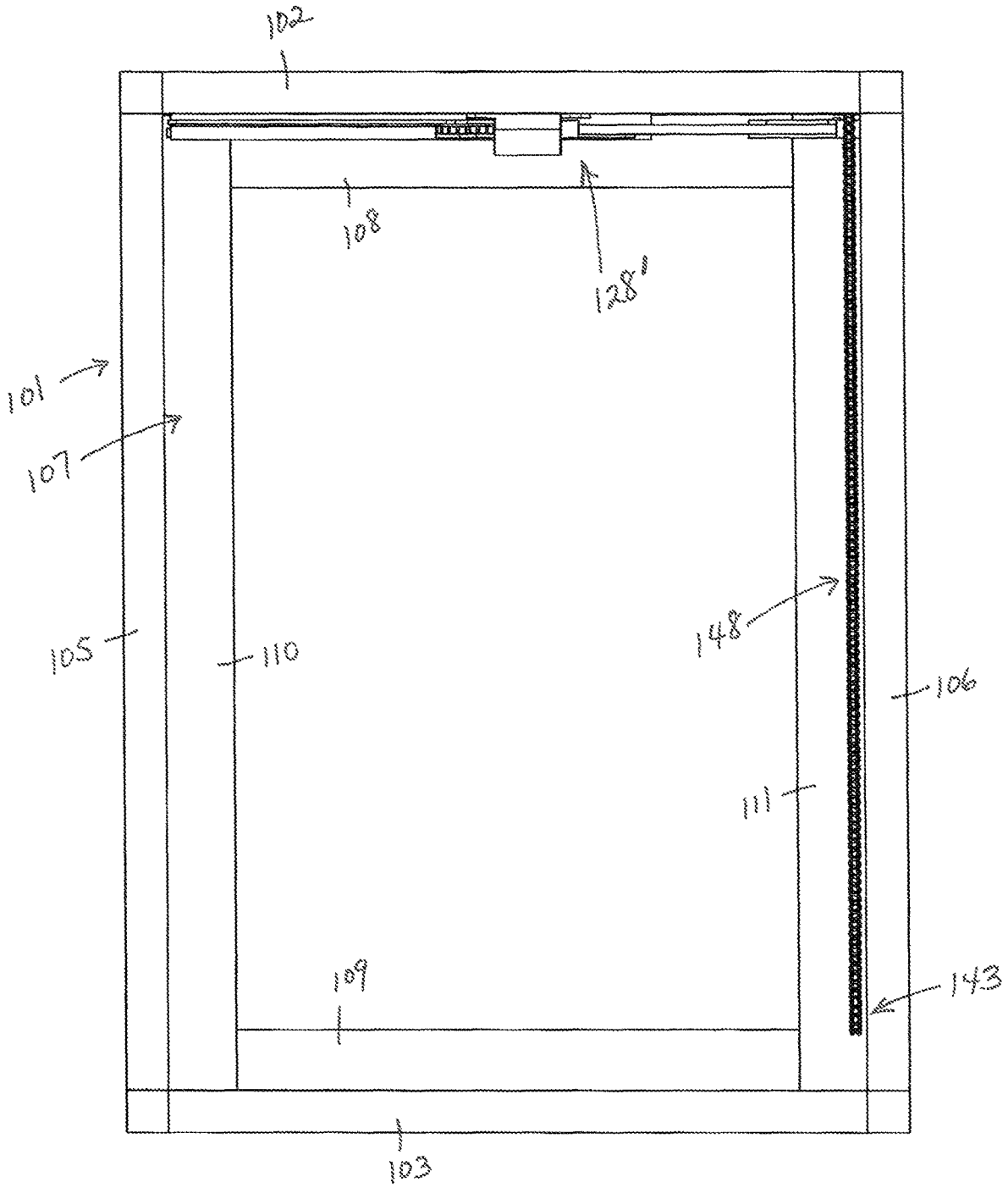
FIG. 7A is a front view of another embodiment window operating system constructed in accordance with the principles of the present invention connected to a casement window in a closed position.
Figure 7B:
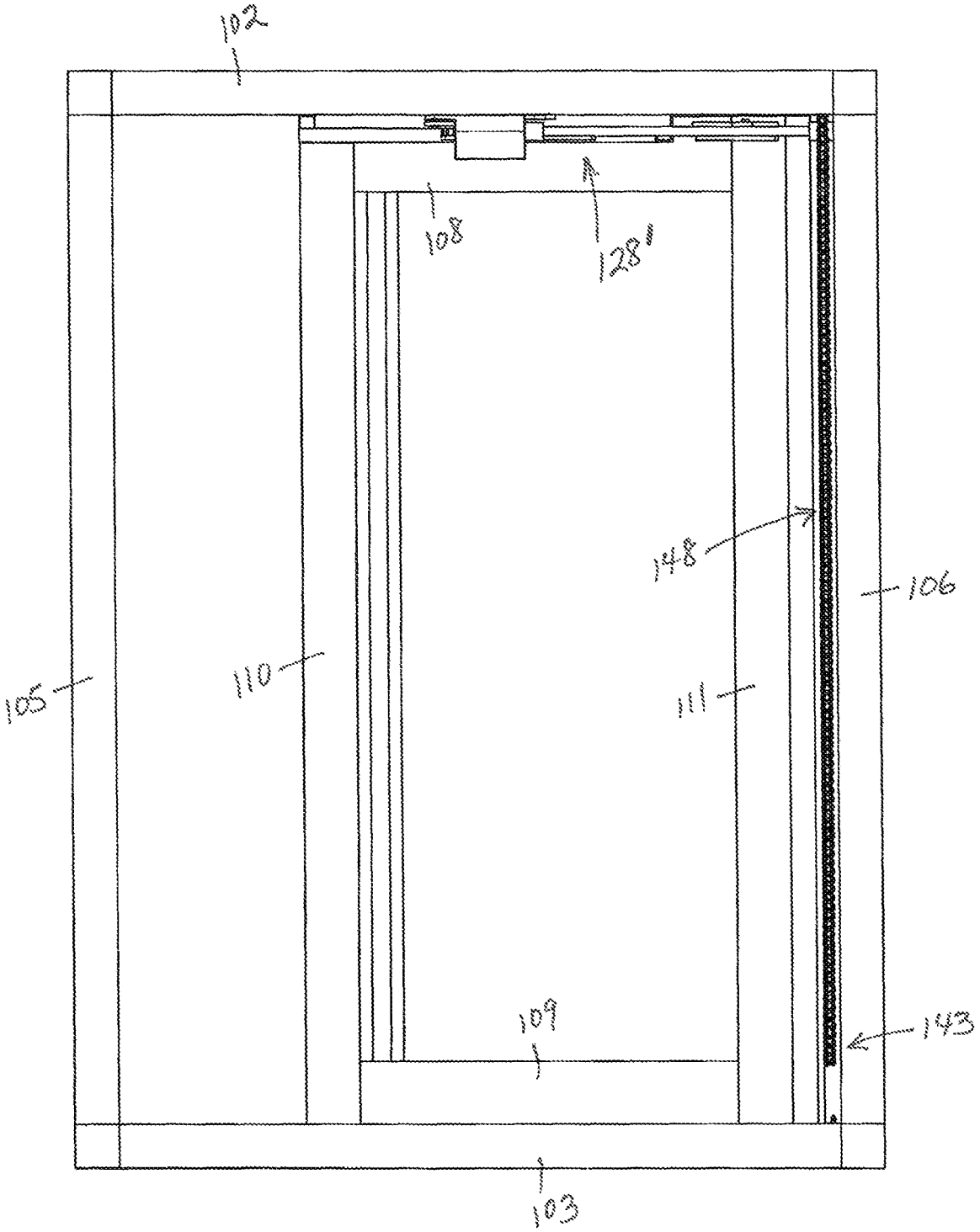
FIG. 7B is a front view of the window operating system and the casement window shown in FIG. 7A in an open position.

In one embodiment, illustrated in FIGS. 7A and 7B, the operator assembly includes a top operator assembly 128', and the elongate member 148 is illustrated as a chain. This embodiment is similar to the embodiment illustrated in FIGS. 16-19 but with a top operator assembly instead of a bottom operator assembly. The operator assembly 128' could be positioned to position the elongate member 148 and the pulley 143 in any suitable location along either side of the frame 101.

The above specification, examples, and data provide a complete description of the manufacture and use of the composition of embodiments of the disclosure. Although specific embodiments have been illustrated and described herein, it will be appreciated by those of ordinary skill in the art that any arrangement, which is calculated to achieve the same purpose, may be substituted for the specific embodiment shown. This application is intended to cover any adaptations or variations of the disclosure.

The invention claimed is:

1. A window operating system for moving a window sash between an open position and a closed position, a window having a top member operatively connected to a bottom member by a first side member and a second side member to form a frame, the sash mounted to the frame for relative movement between the open and closed positions, the window operating system comprising:

an operator configured and arranged to connect to the frame and including a rotating member, a rod, and one of an elongate member or a motor, the rod having a proximal end and a distal end, the proximal end being operatively connected to the one of the elongate member or the motor, the distal end being operatively connected to the rotating member, the rotating member and the rod extending parallel to a longitudinal axis of a portion of the frame to which the rod is operatively connected, wherein movement of the one of the elongate member or the motor rotates the rod and the rotating member;

a first gear having first teeth mating with the rotating member;

a second gear having second teeth mating with the first teeth;

a first arm operatively connected to the second gear and configured and arranged to connect to the window sash;

a second arm pivotally operatively connected to the first gear and the second gear and configured and arranged to connect to the window sash;

wherein rotational movement of the rod, via movement of the one of the elongate member or the motor, rotates the rotating member thereby rotating the first gear, which rotates the second gear, which moves the second gear about the first gear thereby moving the first and second arms about the first gear, which moves the window sash relative to the frame.

2. The window operating system of claim 1, wherein the second arm includes an extension to which the second gear and the first gear are pivotally operatively connected.

3. The window operating system of claim 1, wherein the elongate member extends perpendicular to the rod and along another portion of the frame adjacent the portion to which the rod is operatively connected.

4. The window operating system of claim 1, further comprising one of a sprocket or a pulley operatively connected to the proximal end, wherein the elongate member is routed about the one of the sprocket or the pulley and movement of the elongate member rotates the rotating member.

5. The window operating system of claim 1, wherein the elongate member is selected from the group consisting of a chain, a belt, a cable, and a cord.

6. The window operating system of claim 1, wherein the operator is a bottom operator.

7. The window operating system of claim 5, further comprising a top operator.

8. The window operating system of claim 1, wherein the operator is a top operator.

9. The window operating system of claim 1, wherein the motor extends in line with the rod.

10. The window operating system of claim 1, wherein the rotating member is a worm.

11. A window operating system for moving a window sash between an open position and a closed position, a window having a top member operatively connected to a bottom member by a first side member and a second side member to form a frame, the sash mounted to the frame for relative movement between the open and closed positions, the window operating system comprising:

an operator configured and arranged to connect to the frame, the operator including a worm, a rod, and an elongate member, the rod having a proximal end and a distal end, the proximal end being operatively connected to one of a sprocket or a pulley, the distal end being operatively connected to the worm, the rod and the worm extending parallel to a longitudinal axis of a portion of the frame to which the rod is operatively connected, the elongate member being operatively connected to the sprocket or the pulley and extending perpendicular relative to the rod and along another portion of the frame adjacent the portion to which the rod is operatively connected, wherein movement of the elongate member rotates the one of the sprocket or the pulley, the rod, and the worm;

a first gear having first teeth mating with the worm;

a second gear having second teeth mating with the first teeth;

a first arm operatively connected to the second gear and configured and arranged to connect to the window sash;

a second arm pivotally operatively connected to the first gear and the second gear and configured and arranged to connect to the window sash, the second arm including an extension to which the second gear and the first gear are pivotally operatively connected;

wherein rotational movement of the rod, via movement of the elongate member rotating the one of the sprocket or the pulley, rotates the worm thereby rotating the first gear, which rotates the second gear, which moves the second gear about the first gear thereby moving the first and second arms about the first gear, which moves the window sash relative to the frame.

12. The window operating system of claim 11, wherein the elongate member is selected from the group consisting of a chain, a belt, a cable, and a cord.

13. The window operating system of claim 11, wherein the operator is a bottom operator.

14. The window operating system of claim 13, further comprising a top operator.

15. The window operating system of claim 11, wherein the operator is a top operator.

16. A window operating system for moving a window sash between an open position and a closed position, a window having a top member operatively connected to a bottom member by a first side member and a second side member to form a frame, the sash mounted to the frame for relative movement between the open and closed positions, the window operating system comprising:

an operator configured and arranged to connect to the frame, the operator including a worm, a rod, and a motor, the rod having a proximal end and a distal end, the proximal end being operatively connected to the motor, the distal end being operatively connected to the worm, the worm, the rod, and the motor extending in line and parallel to a longitudinal axis of a portion of the frame to which the operator is operatively connected, wherein movement of the motor rotates the rod and the worm;

a first gear having first teeth mating with the worm;

a second gear having second teeth mating with the first teeth;

a first arm operatively connected to the second gear and configured and arranged to connect to the window sash;

a second arm pivotally operatively connected to the first gear and the second gear and configured and arranged to connect to the window sash, the second arm including an extension to which the second gear and the first gear are pivotally operatively connected;

wherein rotational movement of the rod, via movement of the motor, rotates the worm thereby rotating the first gear, which rotates the second gear, which moves the second gear about the first gear thereby moving the first and second arms about the first gear, which moves the window sash relative to the frame.

17. The window operating system of claim 16, wherein the operator is a bottom operator.

18. The window operating system of claim 17, further comprising a top operator.

19. The window operating system of claim 16, wherein the operator is a top operator.

* * * * *